US010928167B1

(12) United States Patent
Kitts

(10) Patent No.: US 10,928,167 B1
(45) Date of Patent: Feb. 23, 2021

(54) WEIGHT ADJUSTED TARGET POINT

(71) Applicant: Randy Kitts, Ball Ground, GA (US)

(72) Inventor: Randy Kitts, Ball Ground, GA (US)

( * ) Notice: Subject to any disclaimer, the term of this patent is extended or adjusted under 35 U.S.C. 154(b) by 0 days.

(21) Appl. No.: 16/822,199

(22) Filed: Mar. 18, 2020

Related U.S. Application Data

(60) Provisional application No. 62/833,157, filed on Apr. 12, 2019.

(51) Int. Cl.
*F42B 6/08* (2006.01)
*F42B 6/04* (2006.01)

(52) U.S. Cl.
CPC . *F42B 6/08* (2013.01); *F42B 6/04* (2013.01)

(58) Field of Classification Search
CPC ..... F42B 6/08
See application file for complete search history.

(56) References Cited

U.S. PATENT DOCUMENTS 4,944,520 A * 7/1990 Fingerson ..... F42B 6/04 473/582
5,269,534 A 12/1993 Saunders et al.
5,516,117 A * 5/1996 Rangel ..... F42B 6/04 403/288
5,611,542 A * 3/1997 Saunders ..... F42B 6/08 473/578
8,784,243 B2 * 7/2014 James ..... F42B 6/08 473/582
9,410,773 B2 8/2016 Greenwood
9,933,239 B2 * 4/2018 Johnson ..... F42B 10/24
2017/0299353 A1 * 10/2017 Greenwood ..... F42B 6/04
2019/0265007 A1 * 8/2019 Gizowski ..... F42B 6/08

* cited by examiner

*Primary Examiner* — John A Ricci
(74) *Attorney, Agent, or Firm* — Donald J. Ersler

(57) ABSTRACT

A weight adjusted target point preferably includes a weight collar and an adjustable weight arrow tip. The weight collar includes a round outer diameter and a curved length. The length is curved, such that a diameter of the middle of the weight collar is greater than a diameter at each thereof. An arrow tip shaft bore is formed through the weight collar. A length of the arrow shaft bore is at least the same as an outer diameter of the arrow shaft. The adjustable weight arrow tip includes a target tip and an adjustable length shaft. A largest diameter of the tip is equal to an outer diameter of the weight collar at an arrow tip shaft diameter end. The adjustable length shaft includes a plurality of break away segments. Each break away segment is preferably 10 grains, but other values may also be used.

18 Claims, 2 Drawing Sheets

WEIGHT ADJUSTED TARGET POINT

CROSS-REFERENCE TO RELATED APPLICATIONS

This a nonprovisional patent application, which claims the benefit of provisional patent application No. 62/833,157 filed on Apr. 12, 2019.

BACKGROUND OF THE INVENTION

Field of the Invention

The present invention relates generally to archery and more specifically to a weight adjusted target point, which is located by an outside diameter of an arrow shaft for greater shooting accuracy.

Discussion of the Prior Art

U.S. Pat. No. 5,269,534 to Saunders et al. discloses an adjustable weight arrow point. U.S. Pat. No. 9,410,773 to Greenwood discloses an adjustable archery arrow insert. However, the above patents do not teach or suggest relying on an outer diameter of an arrow shaft for the radial support for the location of a weight collar. The outer diameter of the arrow shaft is ground to a tolerance of 0.0002 inch, which is less than a tolerance of an inside diameter of the arrow shaft.

Accordingly, there is a clearly felt need in the art for a weight adjusted target point, which is located by an outside diameter of an arrow shaft for greater shooting accuracy.

SUMMARY OF THE INVENTION

The present invention provides a weight adjusted target point, which is located by an outside diameter of an arrow shaft for greater shooting accuracy. The weight adjusted target point preferably includes a weight collar and an adjustable weight arrow tip. The weight collar includes a round outer diameter and a curved length. The length is curved, such that a diameter of the middle of the weight collar is greater than a diameter at each thereof. An arrow tip shaft bore is formed through a length of the weight collar. An arrow shaft bore is formed to a depth of at least 60% of a length of the weight collar. A length of the arrow shaft bore is at least the same as an outer diameter of the arrow shaft or arrow shaft bore. Alternatively, a length of the arrow shaft bore is equal to at least twice the outer diameter of the arrow shaft or the arrow shaft bore. The diameter of the arrow shaft bore may vary from 0.1 to 0.25 inches. The weight collar preferably has a weight range between 10 grains to 150 grains.

The adjustable weight arrow tip includes a target tip and an adjustable length shaft. A largest diameter of the tip is preferably equal to an outer diameter of the weight collar at an arrow tip shaft end. The adjustable length shaft includes a plurality of break away segments. Each break away segment is preferably 10 grains, but other values may also be used. In use, a particular weight of the weight collar and an adjustable weight arrow tip with a particular number of segments is decided upon. An end of the arrow shaft is inserted into the arrow shaft bore. A bonding substance is applied to at least one of the adjustable length shaft and an inner diameter of the arrow shaft. The adjustable length shaft is then inserted into the inner diameter of the arrow shaft.

Accordingly, it is an object of the present invention to provide a weight adjusted target point, which is located by an outside diameter of an arrow shaft for greater shooting accuracy.

These and additional objects, advantages, features and benefits of the present invention will become apparent from the following specification.

DETAILED DESCRIPTION OF THE PREFERRED EMBODIMENTS

Figure 1:
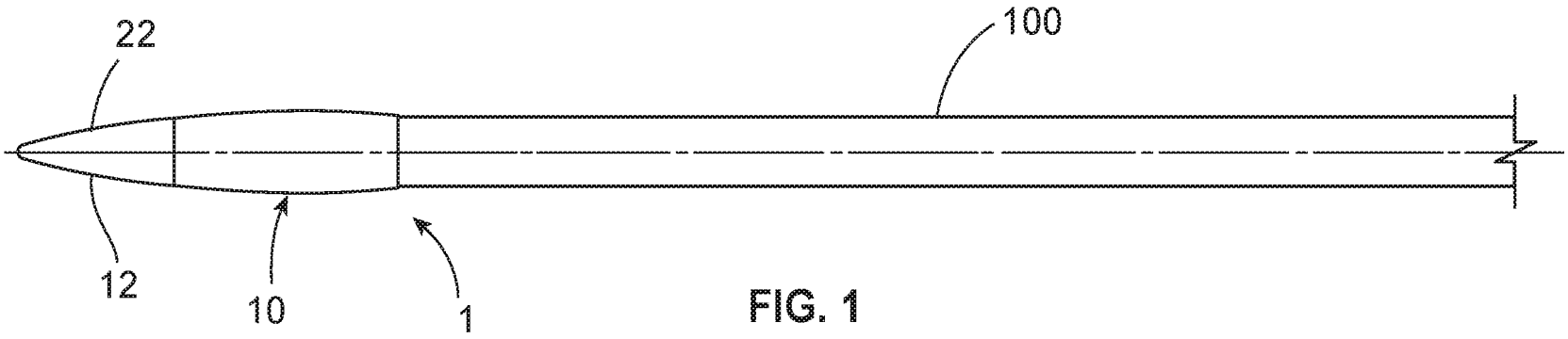
FIG. 1 is a side view of a weight adjusted target point installed in an arrow shaft in accordance with the present invention.
Figure 2:
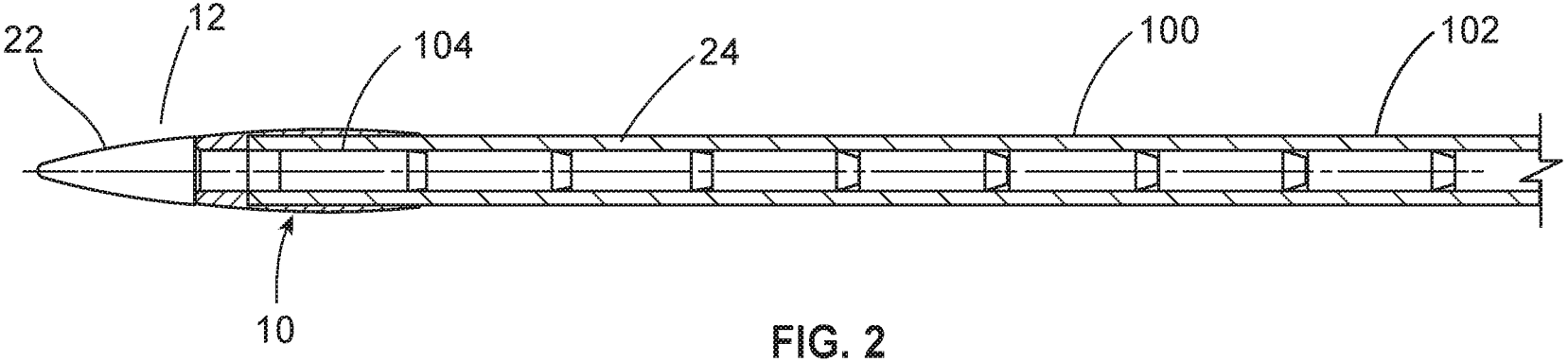
FIG. 2 is a cross sectional view of a weight adjusted target point installed in an arrow shaft in accordance with the present invention.
Figure 3:
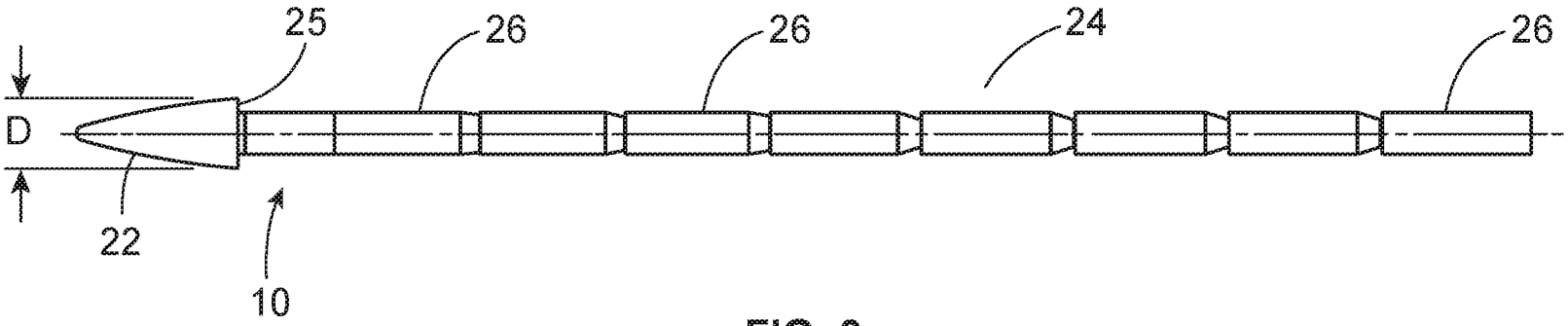
FIG. 3 is a side view of an adjustable weight arrow tip of a weight adjusted target point in accordance with the present invention.
Figure 5:
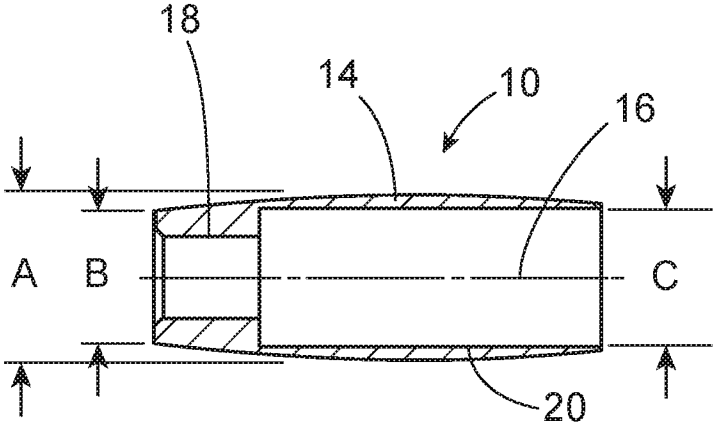
FIG. 5 is a cross sectional view of a weight collar of a weight adjusted target point in accordance with the present invention.
Figure 6:
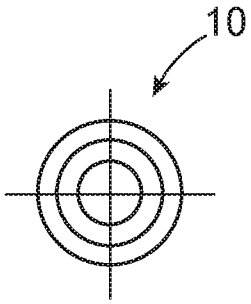
FIG. 6 is an end view of a weight collar of a weight adjusted target point in accordance with the present invention.
Figure 4:
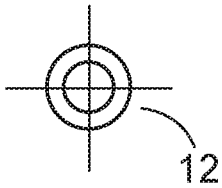
FIG. 4 is an end view of an adjustable weight arrow tip of a weight adjusted target point in accordance with the present invention.

With reference now to the drawings, and particularly to FIG. 1, there is shown a side view of a weight adjusted target point 1. With reference to FIGS. 2-5, the weight adjusted target point 1 preferably includes a weight collar 10 and an adjustable weight arrow tip 12. The weight collar 10 includes a round outer diameter and a curved length 14 relative to a lengthwise axis 16. The curved length 14 is such that a diameter "A" of the middle of the weight collar 10 is greater than a diameter "B" and "C" at each end thereof. An arrow tip shaft bore 18 is formed through a length of the weight collar 10. An arrow shaft bore 20 is formed to a depth of at least 60% of a length of the weight collar 10. A length of the arrow shaft bore 20 is at least the same as an outer diameter 102 of an arrow shaft 100 or the arrow shaft bore 20. Alternatively, a length of the arrow shaft bore 20 is equal to at least twice the outer diameter 102 of the arrow shaft 100 or the arrow shaft bore 20. The diameter of the arrow shaft bore 20 may vary from 0.1 to 0.25 inches. The weight collar 10 preferably has a weight range between 10 grains to 150 grains.

The adjustable weight arrow tip 12 includes a target tip 22 and an adjustable length shaft 24. A largest diameter "D" of the target tip 22 is preferably equal to the outer diameter B of the weight collar 10 at an arrow tip shaft diameter end 25. The adjustable length shaft 24 includes a plurality of break away segments 26. Each break away segment 26 is preferably 10 grains, but other values may also be used. The weight collar 10 and the adjustable weight arrow tip 12 are preferably fabricated from stainless steel.

In use, a particular weight of the weight collar 10 and an adjustable weight arrow tip 12 with a particular number of segments 26 is decided upon. An end of the arrow shaft 100 is inserted into the arrow shaft bore 20. A bonding substance is applied to at least one of the adjustable length shaft 24 and an inner diameter 104 of the arrow shaft 100. The adjustable length shaft 24 is then inserted into the inner diameter 104 of the arrow shaft 100.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A weight adjusted target point for installation in an end of an arrow shaft, comprising:

a weight collar includes an arrow tip shaft bore formed there through, a shaft counter bore is formed in said weight collar to receive an outer diameter of an arrow shaft, a depth of said shaft counter bore is at least 60% of a length of said weight collar; and an adjustable weight arrow tip includes a target tip and an adjustable length shaft, said adjustable length shaft extends from a rear of said target tip, said adjustable length shaft includes a plurality of break away segments, said arrow tip shaft bore is sized to receive said adjustable length shaft.

2. The weight adjusted target point for installation in an end of an arrow shaft of claim 1 wherein:

said weight collar includes a curved length relative to a lengthwise axis.

3. The weight adjusted target point for installation in an end of an arrow shaft of claim 1 wherein:

said adjustable length shaft is bonded to an inner diameter of the arrow shaft.

4. The weight adjusted target point for installation in an end of an arrow shaft of claim 1 wherein:

a largest diameter of said target tip is equal to an end diameter of said weight collar adjacent to said arrow tip shaft bore.

5. The weight adjusted target point for installation in an end of an arrow shaft of claim 1 wherein:

each one of said plurality of break away segments has a weight of 10 grains.

6. A weight adjusted target point for installation in an end of an arrow shaft, comprising:

a weight collar includes an arrow tip shaft bore formed there through, a shaft counter bore is formed in said weight collar to receive an outer diameter of an arrow shaft, a length of said shaft counter bore is at least twice a length of a diameter of said shaft counter bore; and an adjustable weight arrow tip includes a target tip and an adjustable length shaft, said adjustable length shaft extends from a rear of said target tip, said adjustable length shaft includes a plurality of break away segments, said arrow tip shaft bore is sized to receive said adjustable length shaft.

7. The weight adjusted target point for installation in an end of an arrow shaft of claim 6 wherein:

said weight collar includes a curved length relative to a lengthwise axis.

8. The weight adjusted target point for installation in an end of an arrow shaft of claim 6 wherein:

said adjustable length shaft is bonded to an inner diameter of the arrow shaft.

9. The weight adjusted target point for installation in an end of an arrow shaft of claim 6 wherein:

a largest diameter of said target tip is equal to an end diameter of said weight collar adjacent to said arrow tip shaft bore.

10. The weight adjusted target point for installation in an end of an arrow shaft of claim 6 wherein:

said weight collar has a weight range between 10 grains to 150 grains.

11. The weight adjusted target point for installation in an end of an arrow shaft of claim 6 wherein:

each one of said plurality of break away segments has a weight of 10 grains.

12. The weight adjusted target point for installation in an end of an arrow shaft of claim 6 wherein:

said weight collar and said adjustable weight arrow tip are fabricated from stainless steel.

13. A weight adjusted target point for installation in an end of an arrow shaft, comprising:

a weight collar includes an arrow tip shaft bore formed there through, a shaft counter bore is formed in said weight collar to receive an outer diameter of an arrow shaft, a length of said shaft counter bore is at least 60% of a length of said weight collar; and an adjustable weight arrow tip includes a target tip and an adjustable length shaft, said adjustable length shaft extends from a rear of said target tip, said adjustable length shaft includes a plurality of break away segments, said arrow tip shaft bore is sized to receive said adjustable length shaft.

14. The weight adjusted target point for installation in an end of an arrow shaft of claim 13 wherein:

said weight collar includes a curved length relative to a lengthwise axis.

15. The weight adjusted target point for installation in an end of an arrow shaft of claim 13 wherein:

said adjustable length shaft is bonded to an inner diameter of the arrow shaft.

16. The weight adjusted target point for installation in an end of an arrow shaft of claim 13 wherein:

a largest diameter of said target tip is equal to an end diameter of said weight collar adjacent to said arrow tip shaft bore.

17. The weight adjusted target point for installation in an end of an arrow shaft of claim 13 wherein:

said weight collar has a weight range between 10 grains to 150 grains.

18. The weight adjusted target point for installation in an end of an arrow shaft of claim 13 wherein:

each one of said plurality of break away segments has a weight of 10 grains.

* * * * *